United States Patent [19]

Feess

[11] 4,314,812

[45] Feb. 9, 1982

[54] TWO-PHASE PRINTING PROCESS FOR PREPARING CONVERSION ARTICLES AND DISCHARGE RESIST PRINTS

[75] Inventor: Erich Feess, Hofheim am Taunus, Fed. Rep. of Germany

[73] Assignee: Hoechst Aktiengesellschaft, Fed. Rep. of Germany

[21] Appl. No.: 165,029

[22] Filed: Jul. 1, 1980

[30] Foreign Application Priority Data

Jul. 2, 1979 [DE] Fed. Rep. of Germany ..... 2926651

[51] Int. Cl.[3] ..... D06P 5/15

[52] U.S. Cl. ..... 8/457; 8/449; 8/463; 8/465; 8/592; 8/640; 8/642; 8/918

[58] Field of Search ..... 8/457, 463, 465, 592, 8/918, 449, 642

[56] References Cited

U.S. PATENT DOCUMENTS

| | | | |
|---|---|---|---|
| 1,957,491 | 5/1934 | Dreyfus et al. | 8/465 |
| 3,700,402 | 10/1972 | Noda et al. | 8/592 |
| 3,972,677 | 8/1976 | Feess et al. | 8/592 |

FOREIGN PATENT DOCUMENTS

| | | |
|---|---|---|
| 54-156884 | 12/1979 | Japan . |
| 54-156885 | 12/1979 | Japan . |
| 829443 | 3/1960 | United Kingdom . |
| 936644 | 9/1963 | United Kingdom . |

*Primary Examiner*—A. Lionel Clingman
*Attorney, Agent, or Firm*—Connolly and Hutz

[57] ABSTRACT

According to two-phase processes multi-color effects are obtained on cellulosic materials, namely conversion effects with reactive and vat dyestuffs on the one hand and discharge resist prints with reactive dyestuffs and, optionally, vat dyestuffs on the other hand, by printing or padding the reactive dyestuff or a mixture of reactive and vat dyestuffs in a weakly acidic medium onto the material, overprinting this material with a neutral paste containing a stable discharging agent of the sulfinic acid series and, if desired, a vat dyestuff, drying the print, contacting the material with an aqueous strongly alkaline liquor, steaming it and finishing the article in known manner, depending on the choice of dyestuffs.

10 Claims, No Drawings

TWO-PHASE PRINTING PROCESS FOR PREPARING CONVERSION ARTICLES AND DISCHARGE RESIST PRINTS

The present invention relates to two-phase printing processes for preparing conversion articles with reactive and vat dyestuffs and discharge resist prints with reactive and optionally vat dyestuffs on cellulosic materials, which comprises printing or padding the material with a weakly acidic printing paste or padding liquor containing the reactive dyestuff or a mixture of reactive and vat dyestuffs, overprinting the material with a neutral printing paste containing a stable reducing agent of the sulfinic acid series and, if desired, a vat dyestuff, drying the material, contacting it with an aqueous strongly alkaline liquor, steaming it and finishing the article.

In textile printing, contrary to paper printing, where the autotype polychromic technique prevails, the preparation of multicolored articles requires extremely high costs, for a separate roll or screen is necessary for each shade, except overprint areas. It is therefore especially advantageous to increase the number of shades contained in a print pattern in a different way, for example by conversion printing.

In conversion printing the fiber materials to be colored are printed with slightly acidic printing pastes containing mixtures of reactive and vat dyestuffs, then submitted to an intermediate drying step or suitably overprinted in the same process step in wet state with neutral printing colors which contain reducing agents that are stable under the conventional drying conditions, for example sodium formaldehyde sulfoxylate, in an amount of from 100 to 200 g per kg of printing paste. After drying, the printed material is passed through a strongly alkaline liquor containing e.g. from 100 to 200 g of a 32.5% by weight sodium hydroxide solution per liter of liquor or equivalent quantities of sodium or potassium carbonate or of water glass, and subsequently treated for about 5 to 30 seconds, preferably for 10 to 20 seconds, with saturated steam or overheated steam.

The dyestuffs may alternatively be applied in a different way, for example by padding or nip-padding. The alkali may alternatively be applied to the print in a different way, for example by nip-padding or spraying.

The term "weakly acidic" implies that the printing paste or the padding liquor has a pH which is sufficiently low as to ensure that the reactive dyestuff is not fixed on the cellulose. This "threshold" pH value depends on the dyestuff and the physical conditions applied but is generally in the range of 5 to 6.5. Sodium dihydrogenphosphate is especially appropriate to adjust this pH range.

In the said process, the reactive dyestuff is fixed only on the areas printed with dyestuff mixture and which have not been overprinted with the reducing agent, while the reactive dyestuff is discharged and the vat dyestuff is developed whereever the material has been contacted with the reducing agent.

A prerequisite of this known procedure is that the reducing agent used on the one hand is stable under the drying conditions and on the other hand is capable of reacting so rapidly that the vat dyestuffs can be fixed within a short steaming period. This steaming period must not be exceeded to prevent a damaging of the reactive dyestuffs, for in a longer steaming period the bond between the dyestuff and the fiber would be destroyed owing to the great quantities of alkali present in the padding liquor.

Suitable reducing agents are in the first place alkali metal and alkaline earth metal salts of sulfinic acids, which are obtained by a reaction with aldehydes or amines and stabilized thereby, especially sodium formaldehyde sulfoxylate.

It is worth mentioning in this context that the decomposition of a stable reducing agents such as sodium formaldehyde sulfoxylate, can be accelerated by great amounts of alkali. Decomposition can moreover be accelerated by catalysts as described in German Pat. No. 1,220,825 and in Melliand Textilberichte, 1967, pages 1341–1345, as additives to printing pastes having a content of vat dyestuffs. These catalysts may be cyano or diacetyldioxime complexes of the heavy metals Fe, Cu, Cr, Mn, Co or Ni. The Cocomplex of diacetyl dioxime has proved particularly advantageous. Suitably from 0.1 to 10 g these metal complexes are added per liter of alkaline padding liquor.

Suitable thickeners are especially mixtures of alginates and starch derivatives, optionally locust bean flour ethers or cellulose ethers.

The technique described hereinbefore can be applied in accordance with the present invention to the discharge printing by dividing the original dyestuff application into two steps, that means that the cellulosic material is printed with a printing paste containing one or several reactive dyestuffs or padded or nippadded with a liquor, subsequently dried and printed with a printing paste, in the manner described for the conversion article, a stable reducing agent and optionally one or several vat dyestuffs having been added to this paste. The rest of the printing procedure is run in analogous manner as the process specified hereinbefore. Ground colors and optionally colors for illuminated discharge prints are fixed during the short steaming period after the material has passed through the alkaline liquor.

Owing to the fact that the procedure specified hereinbefore is a discharge resist process, the reactive coloration has not to be submitted to a finishing operation, which makes the process less expensive.

An addition of hygroscopic substances, such as glycerol, in sufficient amounts to the hitherto employed discharge printing pastes, for example in the classical sulfoxilate process, can be dispensed with in the process according to the invention which involves a satisfactory take up of humidity in the course of the passage through the alkaline padding liquor prior to steaming.

A further advantageous feature of the process of the invention is that the discharge prints after printing, do not have to be deposed and optionally cooled, which step is necessary in the conventional single-stage discharge printing processes for safety reasons, on the contrary, the prints can be submitted to the further treatment steps in completely continuous manner.

Finally the stability of the printing colors and of the prints prior to steaming, when using certain vat dyestuffs, is distinctly higher than in the conventional discharge printing process using alkali and printing colors containing a reducing agent.

This novel method of preparing discharge prints, consequently, involves the following characteristic features:

1. the discharge resist technique,
2. the activation of a reducing agent stable under drying conditions and, thereby, 3. the possible application of the two-phase technique with short-time steaming.

Suitable reactive dyestuffs for the process according to the present invention both for a conversion article and for a discharge print can derive from different organic dyestuff classes, for example azo, anthraquinone or phthalocyanine compounds and should contain at least one reactive group selected from the following radicals: β-hydroxyethylsulfone-sulfuric acid ester, vinylsulfonyl, monochlorotriazine, dichlorotriazine, 2,2,3,3-tetrafluorocyclobutane-1-acryloylamino, vinylsulfonylamino, β-hydroxyethylsulfonylamino-sulfuric acid ester, β-phenylsulfonylpropionylamino or 2,3-dichloroquinoxaline, monofluorotriazine, 2,4-dichloroquinazoline, 1,4-dichlorophthalazine, alkylsulfonylpyrimidine, tri- or tetrachloropyrimidine, 2,4-difluoro-5-chloropyrimidine or 1-aryl-4,5-dichloropyridazone. Preference is given to dyestuffs that contain a vinylsulfonyl group or a precursor thereof.

The vat dyestuffs may belong to the series of the anthraquinone, indigo and naphthoquinone dyes or be derivatives of naphthalenetertacarboxylic acid.

Suitable materials for the process according to the invention are all substrates of cellulosic origin, that means native products such as cotton or linen or regenerated cellulose fibers such as rayon stable fibers or viscose and highly water-resistant variants thereof.

The following examples illustrate the invention. Percentages are by weight. The Colour Index numbers specified in the examples have been taken from the Colour Index, 2nd edition (1956) and from the supplement thereof (1963).

EXAMPLE 1

A cotton fabric is printed in a defined pattern with a printing paste obtained as follows:

| | |
|---|---|
| 40 g | of the commercial powder composition of the dyestuff C.I. No. 14824 |
| 60 g | of the commercial paste composition of the dyestuff C.I. No. 59100 |
| | are dissolved or dispersed in |
| 200 g | of hot water and the resulting solution or dispersion is introduced into |
| 500 g | of a thickener mixture consisting of 2 parts of a 4% aqueous sodium starch glycolate solution and of 1 part of a 10% aqueous sodium starch glycolate solution. |
| 7 g | of sodium meta-nitrobenzene sulfonate and |
| 2 g | of sodium dihydrogenphosphate |
| | are added. |
| 191 g | of water or of the said thickener are added to complete the weight to |
| 1,000 g. | |

The printed fabric is overprinted in the same process step in wet state, in a different pattern, using a printing paste that contains in the same thickener 200 g/kg of sodium formaldehyde sulfoxylate. The material is dried, passed subsequently through an immersion liquor containing 100 g/l of a 32.5% sodium hydroxide solution and 100 g/l of sodium carbonate and steamed immediately thereupon with saturated steam for 20 seconds. After steaming, the print is thoroughly rinsed with cold water, treated at 40° to 50° C. in a bath containing 2 g/l of hydrogen peroxide and 5 ml/l of acetic acid, anew rinsed, washed with 0.5 g/l of a sodium oleyl-N-methyltauride at 90° C., rinsed and dried. A print pattern consisting of red and gold-yellow shades and having good fastness properties is obtained.

EXAMPLE 2

A knitted fabric consisting of rayon stable fibers is printed in the manner described in Example 1 with a printing paste having the same composition as that described in Example 1 but containing 50 g of the commercial powder composition of the dyestuff C.I. No. 17756 and 60 g of the commercial paste composition of the dyestuff C.I. No. 73065, instead of the dyestuffs specified in Example 1.

The printed material is submitted to the after-treatment and finishing operations specified in Example 1.

A print pattern consisting of blue and orange shades of good fastness properties is obtained.

EXAMPLE 3

A fabric consisting of highly water-resistant regenerated celulose fibers is printed, in the manner specified in Example 1, with a printing paste having the same composition as described there but containing 50 g of the commercial powder composition of the dyestuff C.I. No. 18097 and 90 g of the commercial paste composition of the dyestuff C.I. No. 59825, instead of the dyestuffs specified in Example 1.

The printed material is submitted to the after-treatment and finishing operations as specified in Example 1.

A print pattern consisting of violet and green shades having good fastness properties is obtained.

EXAMPLE 4

A cotton fabric is padded on a padding mangle, with a squeeze off effect of 100%, with a dyeing liquor containing per liter 40 g of the commercial powder composition of the dyestuff C.I. No. 61200

7 g of sodium meta-nitrobenzene sulfonate, 3 g of sodium dihydrogenphosphate and 100 g of a 6% aqueous sodium alginate solution.

The padded and dried fabric is printed with a printing paste obtained as follows:

| | |
|---|---|
| 150 g | of a mixture consisting of 72 parts of the commercial paste composition of the dyestuff C.I. No. 73335 28 parts of an analogous paste composition of the dyestuff C.I. No. 73360 are dispersed in |
| 150 g | of water and introduced into |
| 500 g | of a thickener mixture as specified in Example 1. To this mixture there are added |
| 100 g | of sodium formaldehyde sulfoxylate and subsequently |
| 100 g | of water or of the said thickener to complete the weight to |
| 1,000 g. | |

The printed and dried fabric is padded with a liquor take up of 100% with an alkaline liquor containin per liter 150 g of a 32.5% sodium hydroxide solution, 100 g of sodium carbonate, 200 g of water glass (molar ratio of $Na_2O:SiO_2=1:1.7$) and 5 g of dipotassium tetracyanonickelate, and immediately thereafter the material is steamed with saturated steam for 20 seconds. The material is thoroughly rinsed with cold water, subsequently treated at 40° to 50° C. with a bath containing 2 g/l of hydrogen peroxide and 5 ml/l of acetic acid, anew rinsed, washed with 0.5 g/l of a sodium oleyl-N-methyltauride at 90° C., rinsed and dried.

A scarlet colored print on a brilliant blue ground is obtained having good fastness properties.

EXAMPLE 5

A fabric consiting of rayon stable fibers that has been treated in tensionless state with a 4.5% sodium hydroxide solution is padded in the manner specified in Example 4 with a liquor containing per liter 30 g of the commercial composition of the dyestuff C.I. No. 18105 and subsequently printed with a printing paste containing per kg 120 g of the commercial paste composition of the dyestuff C.I. No. 69810, in addition to the components specified in Example 4.

The after-treatment is run as in Example 4.

A deep-blue print on a brilliant red ground is obtained having good fastness properties.

EXAMPLE 6

A cotton knitted fabric is nip-padded with a dyeing liquor that has been prepared with the addition of 60 g of the commercial composition of the dyestuff C.I. No. 20505 in the manner specified in Example 4

The dried material is printed with a printing paste containing per kg 120 g of the commercial paste composition of the dyestuff C.I. No. 68420, the material is dried and padded subsequently, with a liquor take up of 100%, with an alkaline liquor containing per liter 150 g of a 32.5% sodium hydroxide solution, 100 g of sodium carbonate and 4 g of a cobalt(III)-complex of diacetyldioxime.

After padding, the material is steamed with saturated steam for 15 seconds and submitted to the after-treatment and finishing steps specified in Example 4.

A yellow print on a black ground of good fastness properties is obtained.

EXAMPLE 7

A cotton fabric is padded in the manner specified in Example 4 with a liquid containing per liter 40 g of the commercial composition of the dyestuff mixture of the formula

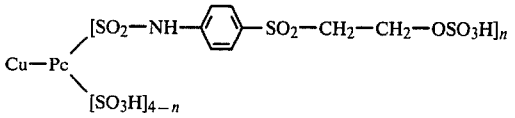

(CuPc=copper phthalocyanine, n=1-3).

The padded and dried fabric is printed with a printing paste consisting of 80 g of the commercial paste composition of the dyestuff C.I. No. 73365, in addition to the additives as specified in Example 4.

The printed material is dried and subsequently passed through an alkaline liquor, with a squeeze off effect of 90%, this liquor containing per liter 200 g of a 32.5% sodium hydroxide solution and 150 g of sodium carbonate.

Subsequently the material is steamed in saturated steam for 20 seconds and submitted to the after-treatment as specified in Example 4.

A blue-red print on a turquoise-blue ground which has good fastness properties is obtained.

EXAMPLE 8

(a) Known process (application of an alkaline liquor containing a reactive dyestuff):

A fabric made from highly water-resistant regenerated cellulose fibers is padded, in the manner specified in Example 4, with a dyeing liquor containing per liter 30 g of the commercial composition of the dyestuff having the formula (in its free acid form)

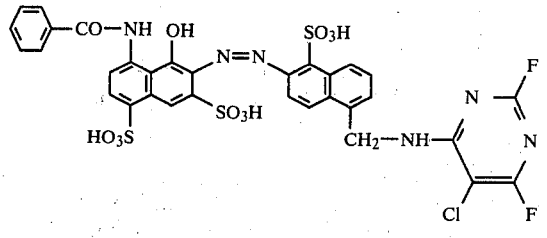

100 g of urea, 10 g of sodium meta-nitrobenzene sulfonate, 3 g of a wetting agent and 12 g of sodium carbonate.

(a1) Part of the dried padded material is printed with a printing pask having the following composition:

120 g of the commercial paste composition of the dyestuff of the formula

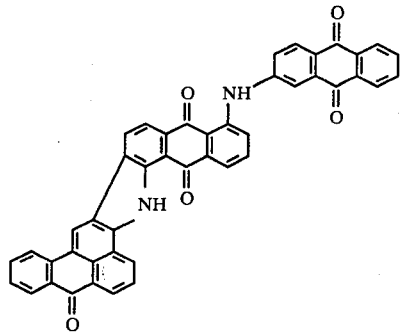

are dispersed in 100 g of water and introduced with agitation into 500 g of the thickener specified in Example 1. Thereto there are added 50 g of glycerol, 100 g of potassium carbonate, 30 g of a 32.5% sodium hydroxide solution, 80 g of sodium formaldehyde sulfoxylate and finally 20 g of water or thickener to complete the weight to 1,000 g.

The printed fabric is steamed with saturated steam for 8 minutes and subsequently rinsed, reoxidized and washed, the latter steps being carried out in the manner specified in Example 4.

A deep-gray print on a brilliant red ground is obtained which has good fastness properties.

(a2) The second part of the padded and dried fabric is printed with the same printing paste as sub (a1), which, however, has been stored for 3 days, and the material is treated in the manner as specified sub (a1). The resulting grey print on a red ground has less than half the tinctorial strength of the first print.

(b) According to the invention:

A fabric as specified above is padded with an analogous dyeing liquor, which, however, only contains the dyestuff and the other components as specified in Example 4 (that means sodium dihydrogenphosphate and alginate instead or urea, wetting agent and sodium carbonate).

(b1) Part of the padded and dried fabric is printed with the same dyestuff as specified above, to which, however, only a thickener and sodium formaldehyde sulfoxylate have been added and the material is submitted to the after-treatment and finishing steps as specified in Example 4.

There is likewise obtained a grey print of high tinctorial strength on a brilliant red ground.

(b2) When repeating the printing process with the use of the same printing color that has been stored for 3 days, there is obtained the same print without a visible reduction of tinctorial strength.

We claim:

1. A two-phase process for preparing conversion articles with reactive and vat dyestuffs or discharge resist prints with reactive dyestuffs or a mixture of reactive and vat dyestuffs on cellulosic materials, which comprises (a) printing or padding the material with a weakly acidic printing paste or padding liquor the pH of which is sufficiently low as to ensure that the reactive dyestuff is not fixed on the cellulose and which contains the reactive dyestuff or the mixture of reactive and vat dyestuffs, (b) overprinting the material with a neutral printing paste containing a stable reducing agent of an alkali metal or an alkaline earth metal salt of a sulfinic acid, (c) drying the material, (d) contacting the material with an aqueous strongly alkaline liquor, (e) steaming the material and (f) finishing the article.

2. A process as claimed in claim 1, wherein the neutral printing paste contains a vat dyestuff.

3. A process as claimed in claim 1, wherein the reducing agent is an alkali metal or alkaline earth metal salt of a sulfinic acid obtained by reaction with an aldehyde or an amine.

4. A process as claimed in claim 3, wherein the reducing agent is sodium formaldehyde-sulfoxylate.

5. A process as claimed in claims 3 or 4, wherein the strongly alkaline liquor contains a cyano complex or a diacetyldioxime complex of iron, copper, chromium, manganese, cobalt or nickel.

6. A process as claimed in claim 1, wherein steaming is performed for 5 to 30 seconds with saturated steam.

7. A process as claimed in claim 1, wherein the weakly acidic printing paste or padding liquor contains sodium dihydrogenphosphate.

8. A process as claimed in claim 1, wherein the strongly alkaline liquor contains an alkali metal hydroxide, carbonate or silicate.

9. A process as claimed in claim 1, wherein the strongly alkaline liquor is applied by passing the material through said liquor or, by spraying or padding the material.

10. A process as claimed in claim 1, wherein the cellulosic material consists essentially of native or regenerated cellulose fibers or of a mixture of such fibers.

* * * * *